United States Patent [19]

Morris

[11] Patent Number: 4,487,149

[45] Date of Patent: Dec. 11, 1984

[54] STEERING PACKAGE FOR VESSELS

[76] Inventor: Nathan Morris, 414 Kentmorr Rd., Stevensville, Md. 21666

[21] Appl. No.: 598,542

[22] Filed: Apr. 10, 1984

Related U.S. Application Data

[63] Continuation of Ser. No. 437,530, Oct. 29, 1982, abandoned.

[51] Int. Cl.[3] ..... B63H 25/42

[52] U.S. Cl. ..... 114/144 E; 114/147; 440/6; 440/900

[58] Field of Search ..... 114/144 R, 144 E, 144 A, 114/144 B, 146–151; 440/3, 6, 7, 49, 53, 79, 80, 84, 113, 900; 248/640–643

[56] References Cited

U.S. PATENT DOCUMENTS

| | | | |
|---|---|---|---|
| 42,642 | 5/1864 | Steering . | |
| 149,568 | 4/1874 | Brooks . | |
| 921,777 | 5/1909 | Yeager . | |
| 1,199.803 | 10/1916 | McDougall . | |
| 2,084,177 | 6/1937 | Alexanderson et al. | 440/6 |
| 2,213,520 | 9/1940 | Gentry | 115/38 |
| 2,359,382 | 10/1944 | Petkoff | 114/147 |
| 3,034,467 | 5/1962 | Pestronk | 440/6 |
| 3,245,640 | 3/1966 | Ibbs | 248/4 |
| 3,251,330 | 5/1966 | Honegger | 114/147 |
| 3,613,137 | 10/1971 | Eccles | 114/362 |
| 3,651,779 | 3/1972 | Norton | 440/53 |
| 4,208,978 | 6/1980 | Eller | 114/151 |
| 4,223,625 | 9/1980 | Puretic | 114/147 |

OTHER PUBLICATIONS

Chadamy Corp., "Stern Thrusters".
Ouden, W. H. Den, "Vetus".
Franklin Electric, "We Build Motors That Go To Sea".

*Primary Examiner*—Trygve M. Blix
*Assistant Examiner*—Stephen P. Avila
*Attorney, Agent, or Firm*—Shapiro and Shapiro

[57] ABSTRACT

A steering thruster for a vessel includes an oil-filled reversible submergible motor driving a reversible-thrust screw. The motor is mounted on a bracket structure at the stern of the vessel and is preferably suspended from a swim platform on the vessel transom. Power for operating the motor is derived from an on-board A.C. generator through an electrical control box which may be mounted on or near the transom and a manual operating switch which may be located in the vessel cockpit or the like. The thruster assembly, may be readily mounted without having to form holes through the hull of the vessel and without having to pull the vessel from the water. The steering package, comprising the thruster assembly, electrical control box and switch provides a convenient, moderate-cost accessory for enhancing the steering characteristics of vessels of up to about 75 feet in length.

7 Claims, 4 Drawing Figures

FIG. 1.
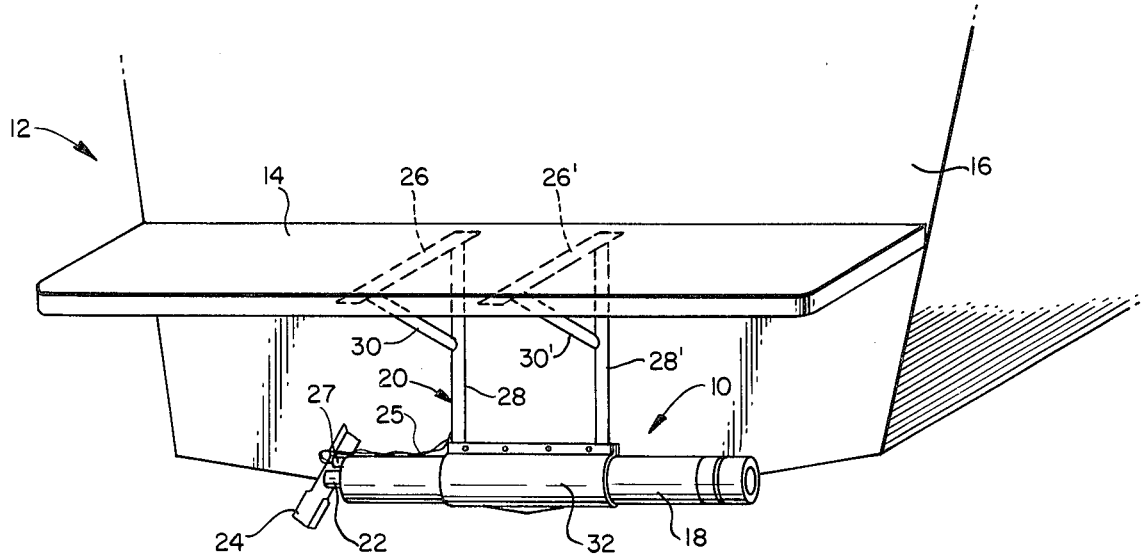
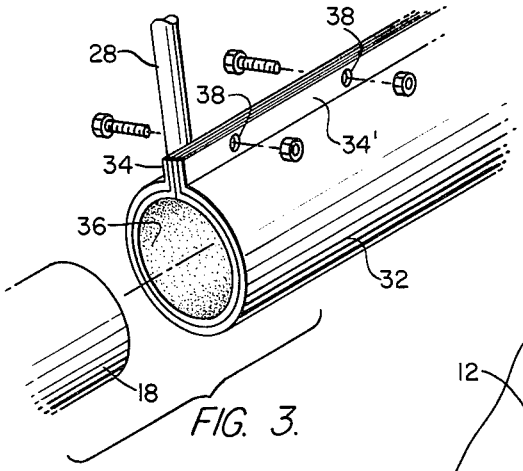
FIG. 3.
FIG. 2.
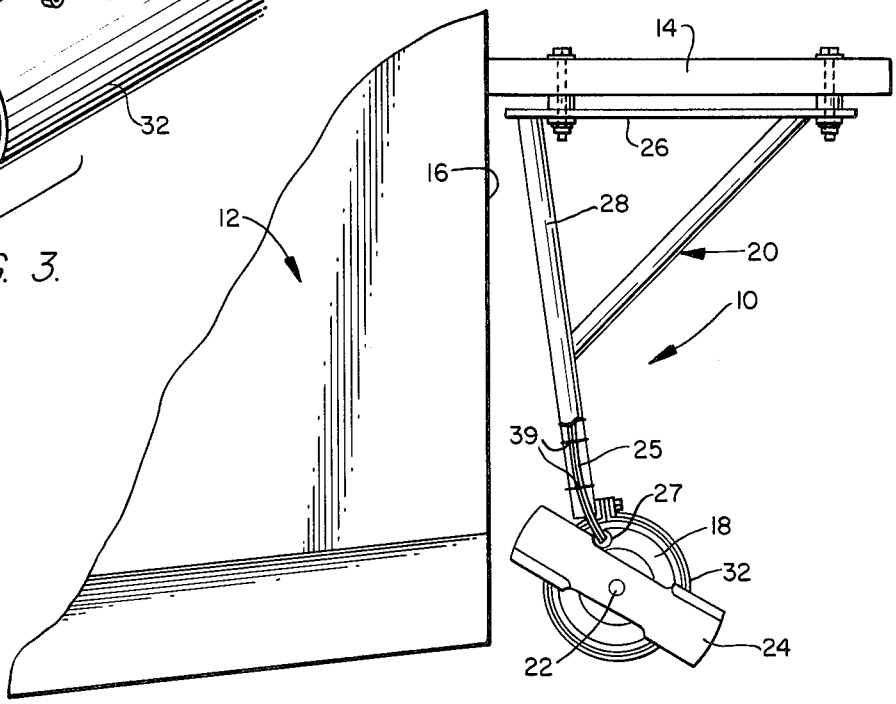

STEERING PACKAGE FOR VESSELS

This application is a continuation of U.S. Ser. No. 437,530, filed Oct. 29, 1982 (now abandoned).

BACKGROUND OF THE INVENTION

The maneuverability of vessels having fixed screws which can only provide forward and reverse thrust is limited. This can be a handicap in confined waters, for example in crowded harbors, marinas and the like where limited space is available for docking, and where a facility for effecting tight turns is an advantage.

The problem of lack of maneuverability of motor-driven vessels has long been recognized and there have been various proposals for equipping vessels with devices for providing lateral thrust at the stern or bow, thereby greatly enhancing the steering characteristics. It has, for example, been proposed to provide a stern or bow thruster in the form of screw or jet mechanism that provides auxiliary lateral thrust as required. The known mechanisms however, tend to be complex and expensive, difficult to install, and inefficient in operation. Additionally, those systems using electrically-driven thrusters generally have been battery-driven, requiring connection to a vessel's D.C. system and tending, with continued use, to cause rapid battery depletion.

The provision of a steering thruster package which is simple to install in a vessel of a moderate size (i.e., up to about 75 feet in length), so that it may, for example, be installed by the owner of the vessel himself, which may be permanently attached in place without producing significant drag and which is simple and inexpensive to maintain and operate appears to have eluded the art. The present invention is directed, inter alia, toward the provision of such a package.

SUMMARY OF THE INVENTION

The invention provides a steering thruster for vessels (boats) of moderate size, i.e., up to about 75 feet in length, which may, in accordance with one advantageous aspect of the invention, be supplied as part of a steering package for installation in situ on a vessel without the need to pull the vessel from the water.

A steering thruster assembly in accordance with the invention may advantageously include a reversible oil-filled submergible electric motor having an output shaft supporting a reversible-thrust screw, and a mounting bracket structure for attaching the motor at the stern of a vessel in a position in which it does not substantially increase the drag of the vessel. For example, the motor may be suspended below a vessel swim platform, being mounted directly to the platform or to the vessel transom, without the need to form any holes through the hull, below the water-line, for mounting purposes.

Conveniently, the submergible motor may be adapted to derive motive power from an on-board A.C. generator, through an electrical control circuit housed in a control box, which may be situated on or near the vessel transom with suitably insulated electric cable running from the control box down to the motor, so that there is again no need to provide cable openings through the hull.

In accordance with a further advantageous feature of the invention, in order to minimize the amount of high voltage cable used, a manual operating switch that may, for example, be situated in the vessel cockpit or the like, may be connected into a low-voltage portion of the control circuit by low-voltage leads extending from the switch to the control box at the stern of the vessel.

Additional features and advantages of the invention will be apparent from the following description of a preferred embodiment.

DESCRIPTION OF DRAWINGS

FIG. 1 is a perspective view of the stern of a vessel equipped with a steering thruster assembly in accordance with the invention, FIG. 2 is an elevational view of the vessel's stern from the left hand side of FIG. 1, FIG. 3 is an exploded perspective view of part of the thruster assembly.

DESCRIPTION OF PREFERRED EMBODIMENT

Figure 4:
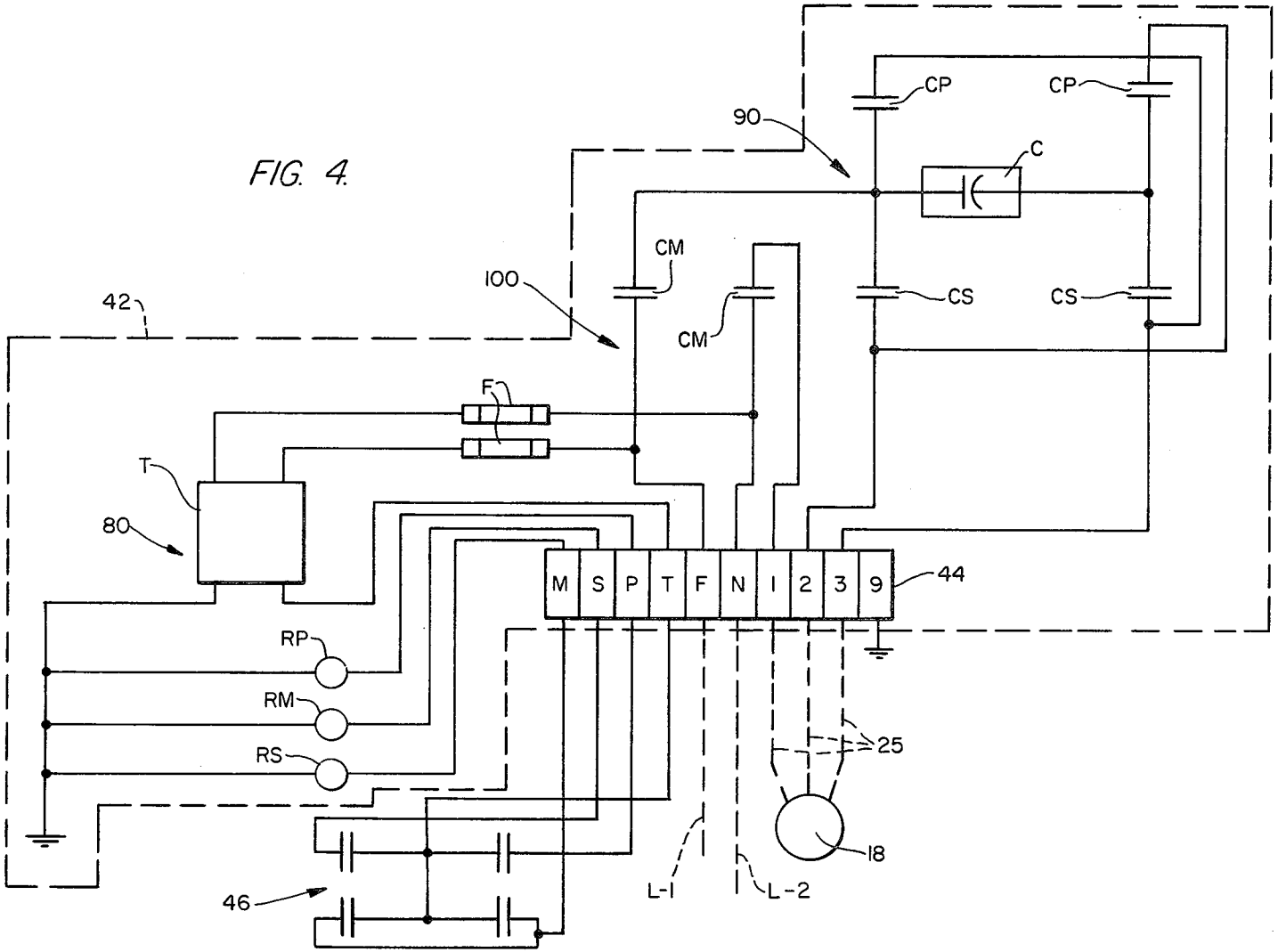
FIG. 4 is a wiring diagram for a steering package including the thruster assembly shown in FIGS. 1–3.

Referring initially to FIGS. 1–3, a steering thruster assembly 10 is shown affixed in operative position at the stern of a vessel 12. In the illustrated embodiment, the vessel has a swim platform 14 secured to the vessel transom 16, and the thruster assembly is suspended beneath the platform.

Assembly 10 comprises an oil-filled reversible submergible motor 18 housed in an elongate cylindrical casing and supported in a mounting bracket structure 20. An output shaft 22 of the motor carries a reversible-thrust screw 24, and high-voltage insulated cable 25, for energizing the motor, is connected thereto by a suitable connector 27. Energization of the motor in one or another direction thus provides equivalent lateral (port or starboard) thrust at the stern of the vessel by rotation of screw 24 in the relevant direction.

Bracket structure 20 may conveniently comprise a pair of horizontal plates 26, 26', legs 28, 28' welded to the undersurfaces of the plates, braces 30, 30' and a motor-retaining sleeve 32 with flanges 34, 34' having aligned bolt openings 38 (see FIG. 3). The bottoms of the respective legs 28, 28' are welded to flange 34 of sleeve 32, and the sleeve includes a resilient vibration-resisting liner 36 of rubber or like material. The diameter of sleeve 32 is such that the motor may be firmly retained therein by tightening the flanges with suitable bolts and nuts inserted in openings 38 (see FIG. 3). Plates 26, 26' may be bolted to the undersurface of the swim platform with interposed resilient washers or the like (see FIG. 2). Cable 25 may extend up and be secured to leg 28 by suitable ties 39.

The dimensions and position of the thruster assembly may be such that motor 18 and screw 24 do not substantially increase the drag of the vessel. To this end the motor and screw may be positioned below the water line but so as not to extend substantially below the hull of the vessel and to be out of the wake of the vessel's primary screw or screws. While the unit is shown mounted with screw 24 facing port, since the motor and screw are reversible, the unit may also be mounted with the screw facing to starboard. All of the metal parts exposed to the water, including the motor casing, shaft, screw 24 and the mounting structure may be of stainless steel.

Motor 18 may be a single phase, electrically reversible oil-filled submergible motor of the capacitor-start, capacitor-run type adapted to operate at the voltage of a conventional on-board A.C. generator (e.g., at about 230 volts). For vessels of up to about 50 feet in length, a motor of 3HP has been found to be sufficient to provide adequate auxiliary steering thrust. A suitable motor of this specification may, for example, be obtained from Grundfos Pumps Corp., 2555 Clovis Avenue, Clovis, Calif. For a motor of this size, screw 24 may be about 7½" in diameter, with a 1½" twist and ¾" offset. The illustrated screw, may for example, be formed by chamfers at opposite ends of, and on opposite sides of a flat plate and by twisting the plate as required. The screw may be mounted on shaft 22 by any known means. To accommodate a 3HP motor, the vessel should have an A.C. generator output of at least about 6 Kw.

In accordance with a further significant aspect of the invention, the thruster assembly described above may be supplied as part of a steering package which also includes motor controls and suitable circuitry for in situ connection to an existing on-board A.C. generator of a vessel. In this regard, attention is directed in particular to FIG. 4 of the drawings showing a typical circuit diagram for an entire steering package.

An electrical control box including all of the electrical components within the dotted line 42 in FIG. 4 may, for example, be mounted on or adjacent the vessel transom. The control box may include a terminal strip 44 having plug-in or other connections 1, 2, 3 for the three leads constituting high-voltage cable 25 leading to motor 18, further plug-in connections F, N for high-voltage leads L-1 and L-2 which may be connected to the vessel's A.C. generator, and still further, plug-in connections M, S, P, T for low voltage leads connected to a three-position DPDT (center "off") manual toggle switch 46 which may be situated in the vessel's cockpit or other suitable operating position. Terminal 9 of the terminal strip may be grounded.

Closing switch 46 in one or another direction from the illustrated neutral position will connect the motor 18 to the generator for operation in one or another direction of rotation of the motor to provide port or starboard thrust, through a low-voltage portion 80 of a circuit 100. The low-voltage portion of the circuit includes relay coils RP, RS, and RM, and a transformer T (of e.g., 230/24 V). A high-voltage portion 90 of the control circuit 100 includes relay contacts CM, CS, CP, and capacitor C. References F indicate fuses.

When switch 46 is open (i.e., in the neutral position) the control circuit remains deenergized so that no power is transmitted between the generator and the motor. When the switch is closed to the left, however, the branches of the low-voltage portion of the circuit which lead from terminals M and S are closed thereby closing the high-voltage portion of the circuit through relay coils RS and RM, and relay contacts CS and CM whereby the motor is operated in a first direction. Likewise, when the switch is closed to the right, the branches of the circuit leading from terminals M and P are closed, energizing the circuit through relay coils RP and RM and contacts CP and CM, whereby the motor is operated in reverse direction.

To install the steering package, it is necessary only to mount the thruster assembly to the vessel's swim platform requiring only four holes to be drilled through the swim platform (or no holes if the platform is slatted), mount the electrical control box at a convenient location, e.g., at or adjacent the transom, mount the operating toggle switch in the vessel cockpit or the like, run low-voltage leads from the switch to the control box and connect up, and run cable from the A.C. generator to the control box and connect up. The steering package may thus be readily installed in situ without the need for any specialized equipment, and without having to make any holes in the vessel's hull. Once installed, the thruster may remain permanently in place and is simple to operate through a single control switch.

The invention provides a steering package of moderate cost utilizing alternating current from a vessel's existing A.C. generator, and having advantages over D.C. driven systems. Thus, the package is designed for long-term use and no additional D.C. equipment need be carried on board. Further, the system has a control circuit of low-voltage, minimizing risk to an operator and requiring only small diameter wiring to the motor compared to the somewhat heavy cables needed in a D.C. system.

While only a single preferred embodiment of the invention has been described in detail, the invention is not limited thereby and modifications may be made within the scope of the attached claims. For example, while the thruster assembly has been described as being attached to a vessel swim platform, for vessels without such a platform, the assembly may be attached directly to the transom. Additionally, the invention may, with suitably scaled-up equipment, be useful on vessels larger than 75 feet in length.

I claim:

1. An auxiliary steering thruster assembly for a boat having an on-board AC generator, comprising a reversible, submergible AC motor with an output shaft having a reversible-thrust screw attached thereto, means for mounting said motor at the stern of the boat, with the motor positioned so that it is maintained submerged and so that it does not substantially increase the drag of the boat, and with the output shaft of the motor extending transversely of the boat, said mounting means comprising bracket means having means for attaching the bracket means to the stern of the boat and having means for holding said motor at a fixed position so that the motor cannot move vertically relative to the boat, and control means for reversibly energizing said motor from AC power supplied by said AC generator, said control means including first cable means for supplying AC power from the AC generator, second cable means for supplying AC power to said motor, relay means for controlling the interconnection of the first and second cable means, voltage converter means for converting the voltage of said AC generator to a substantially lower voltage, and switch means for applying said lower voltage to said relay means to control it.

2. An auxiliary steering thruster assembly in accordance with claim 1, wherein said motor has an elongate cylindrical casing and said bracket means includes a sleeve for receiving and retaining the casing therein.

3. An auxiliary steering thruster assembly in accordance with claim 1, wherein said motor is an oil-filled motor.

4. In combination with a boat having an on-board AC generator, an auxiliary steering thruster assembly comprising a submergible AC motor with an output shaft having a reversible-thrust screw attached thereto, bracket means attached to the stern of the boat and having means for maintaining the motor submerged at a fixed position at which the motor does not substantially increase the drag of the boat, and with the output shaft of the motor extending transversely of the boat, and control means on the boat for reversibly energizing said motor from AC power supplied by said AC generator, said control means including first cable means for supplying AC power from the AC generator, second cable means for supplying AC power to the motor, relay means for controlling the interconnection of the first and second cable means, voltage converter means for converting the voltage of the AC generator to a substantially lower voltage, and switch means for applying said lower voltage to said relay means to control it.

5. A combination as set forth in claim 4, wherein said motor has an elongate cylindrical casing and said bracket means includes a sleeve receiving and retaining the casing therein.

6. A combination as set forth in claim 4, wherein said motor is an oil-filled motor.

7. In combination with a boat having an on-board AC generator and a swim platform extending rearwardly from the stern of the boat, an auxiliary steering thruster assembly comprising a submergible AC motor with an output shaft having a reversible-thrust screw attached thereto, bracket means suspended directly from the swim platform and having means for holding the motor submerged at a fixed position at which the motor does not substantially increase the drag of the boat, and with the output shaft of the motor extending transversely of the boat, and control means on the boat for reversibly energizing said motor from AC power supplied by said AC generator.

* * * * *